United States Patent [19]

Navarro

[11] 4,305,635

[45] Dec. 15, 1981

[54] FLAT CONDUCTOR FLAT CABLE ADAPTOR

[75] Inventor: John N. Navarro, Pasadena, Calif.

[73] Assignee: Thomas & Betts Corporation, Raritan, N.J.

[21] Appl. No.: 90,866

[22] Filed: Nov. 2, 1979

[51] Int. Cl.[3] ..... H01R 4/24

[52] U.S. Cl. ..... 339/99 R; 339/176 MF

[58] Field of Search ..... 174/117 A, 135; 428/40, 428/41; 339/17 F, 176 MF, 98, 99, 278 R

[56] References Cited

U.S. PATENT DOCUMENTS

| | | | |
|---|---|---|---|
| 3,444,506 | 5/1969 | Wedekind | 339/99 R |
| 3,994,554 | 11/1976 | Navarro | 339/99 R |
| 4,027,941 | 6/1977 | Narozny | 339/98 |

FOREIGN PATENT DOCUMENTS

| | | | |
|---|---|---|---|
| 1417256 | 9/1964 | France | 174/117 A |
| 595541 | of 1959 | Italy | 174/117 A |
| 215873 | 5/1924 | United Kingdom | 174/117 A |

*Primary Examiner*—John McQuade

*Attorney, Agent, or Firm*—Robert M. Rodrick; Jesse Woldman

[57] ABSTRACT

An adaptor to be adhered to one surface of a flat conductor flat cable to permit the individual flat conductors to be aligned with the contacts in a round conductor flat cable. The adaptor has an undulating upper surface which permits alignment between the round conductor alignment ridges and the flat conductor cable. Made of a permeable, elastic memory material, after the contacts break it, it recovers to provide support for the cable, prevent lateral shifts of the contacts and fill the void created by introducing a flat conductor cable between the base and cover of the connector.

15 Claims, 13 Drawing Figures

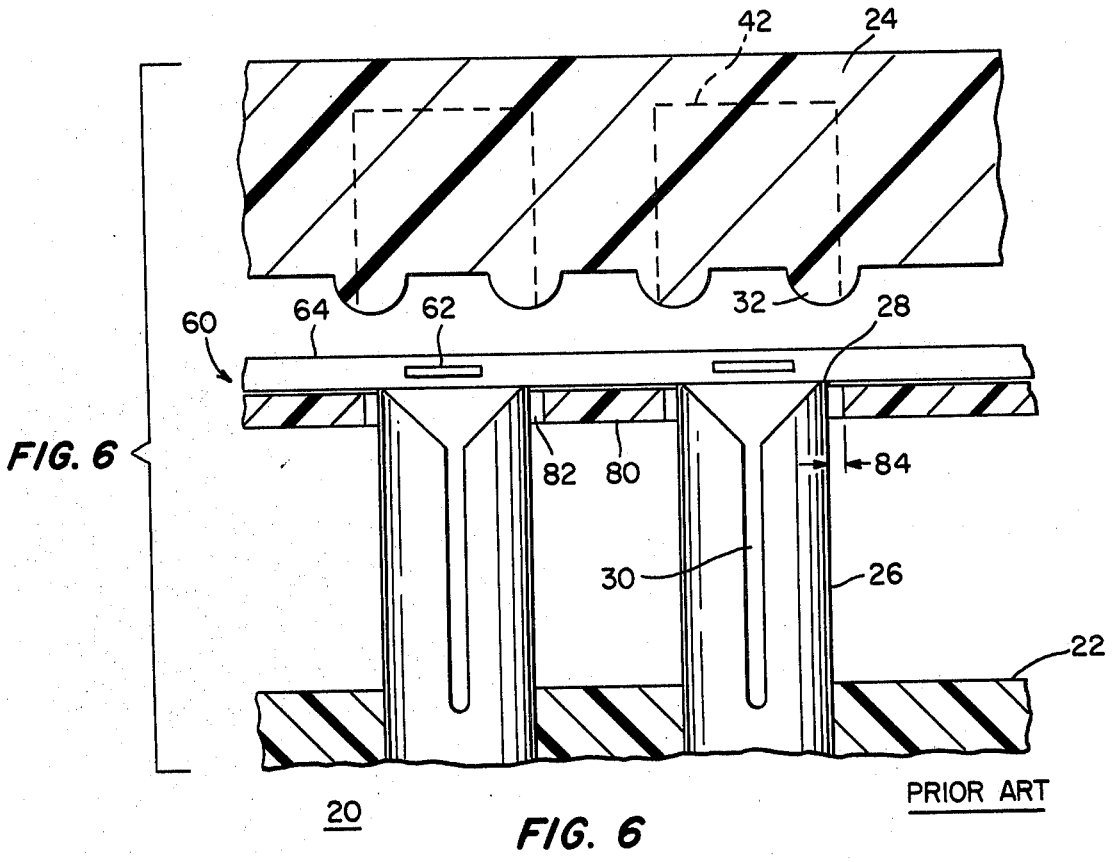
FIG. 6
FIG. 6
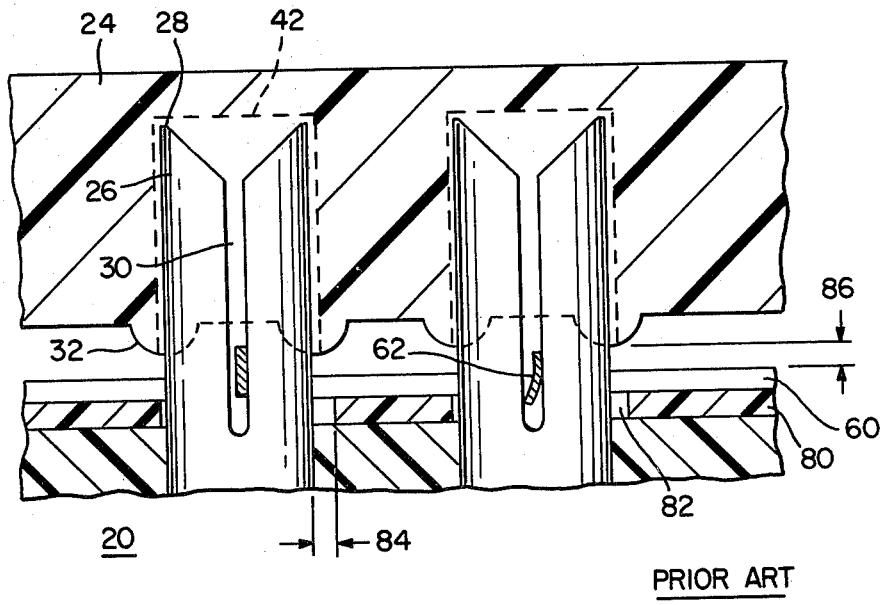
FIG. 7

FLAT CONDUCTOR FLAT CABLE ADAPTOR

BACKGROUND OF THE INVENTION

1. Field of the Invention

The invention is directed to the field of mass termination of flat cables and more particularly to terminating flat conductor flat cable in connectors designed to terminate round conductor flat cable.

2. Description of the Prior Art

In his earlier patent, U.S. Pat. No. 3,994,554, issued Nov. 30, 1976, entitled "Flat Conductor Flat Cable Adaptor" and assigned to the assignee of the instant invention, John Navarro describes a rigid adaptor, flat on both sides with an adhesive layer on one side. The adaptor is prepunched with holes large enough to accommodate contacts at their greatest dimension. When contacts at the small end of the tolerance scale or even normal-sized contacts are used the adaptor provides a lot of slop which does not support the contact but rather allows for the cable to shift about the contact laterally. Also, the rigid nature of the adaptor provides no support for the cable and, finally, the fixed height of the adaptor does not permit it to accommodate the extra space available when a flat conductor flat cable is used in a connector designed for a round conductor flat cable.

SUMMARY OF THE INVENTION

The present invention overcomes the difficulties and deficiencies of the prior art by providing an adaptor which compensates for the difference in height between a flat conductor flat cable and a round conductor flat cable, supports the flat conductor flat cable with which it is used and prevents lateral movement of the cable about the contacts. An adaptor made of a permeable material having a high elastic memory is fashioned to have one flat surface upon which a layer of pressure-sensitive adhesive with appropriate release layer is placed so that the adaptor can be affixed to a flat conductor flat cable. The second surface undulates such that the crests of the undulations fit between the ridges in the connector cover while the ridges fit in the troughs between the crests to guide the flat conductor flat cable into the connector. A series of notches centered on the crests of the adaptor convolutions permit the adaptor to be fixed to the cable. It is an object of this invention to provided an improved adaptor for flat conductor flat cable.

It is another object of this invention to provide an improved adaptor to permit flat conductor flat cable to be accommodated in a round conductor flat cable connector.

It is another object of this invention to provide an adaptor having no prepunched apertures to receive the contacts of the connector.

It is an object of the invention to provide an adaptor fabricated from a permeable elastic memory material.

It is still an object of the invention to provide an adaptor which can prevent lateral movement of the adaptor, support the cable and fill the void between the cable and the connector due to the use of flat conductor flat cable.

It is yet another object of this invention to provide an adaptor having a flat first surface to receive an adhesive layer thereon and permit such adaptor to be adhered to a flat conductor flat cable and an undulating second surface with notches in the marginal edges to align such adaptor with the flat conductors of a flat cable.

Other objects and features of the invention will be pointed out in the following description and claims and illustrated in the accompanying drawings, which disclose, by way of example, the principle of the invention, and the best mode which has been contemplated for carrying it out.

BRIEF DESCRIPTION OF THE DRAWINGS

In the drawings in which similar elements are given similar reference characters:

FIG. 6 is an exploded, partly in section, side elevation of a portion of the connector of FIG. 1 in its pre-latched condition with a prior art adaptor installed to a flat conductor flat cable placed within such connector.

FIG. 7 shows the connector of FIG. 6 in the fully latched condition.

DESCRIPTION OF THE PREFERRED EMBODIMENTS

Figure 1:
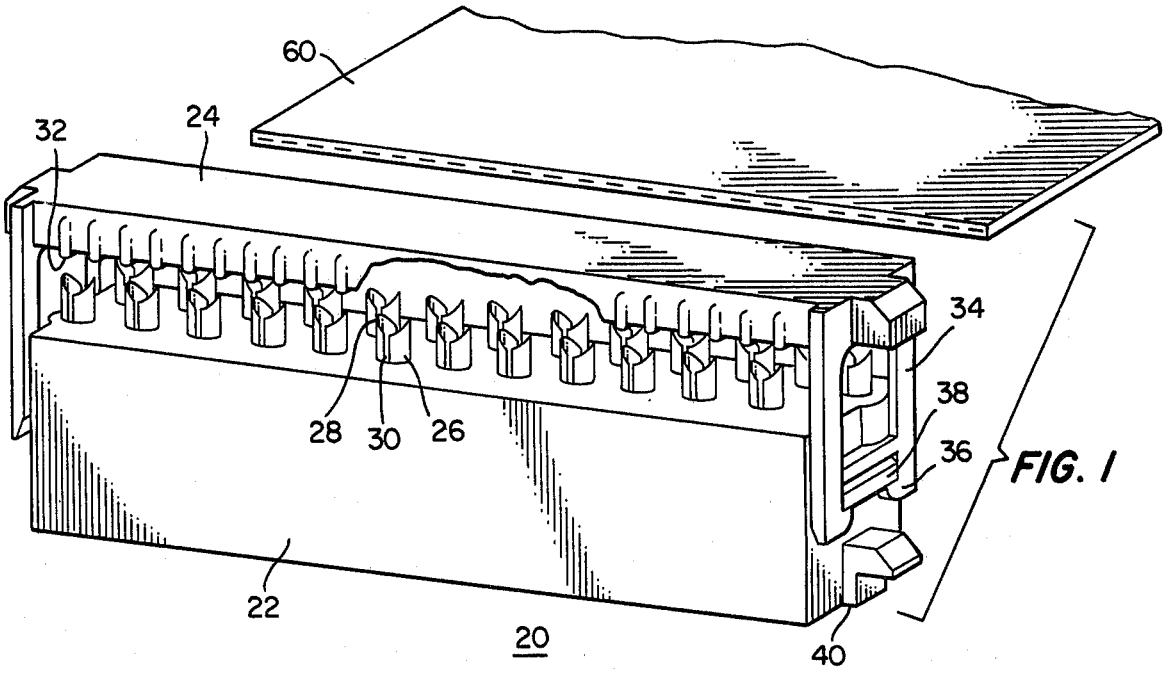
FIG. 1 is an exploded front perspective view, partially fragmented, of a typical round conductor flat cable connector and a length of flat conductor flat cable.
Figure 2:
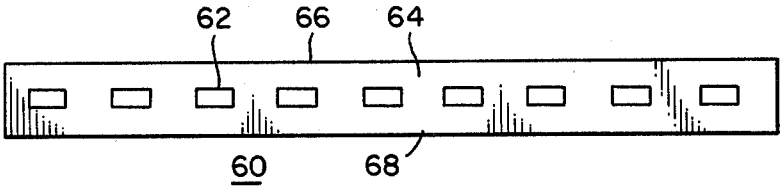
FIG. 2 is an end elevational view of the flat conductor flat cable of FIG. 1.
Figure 3:
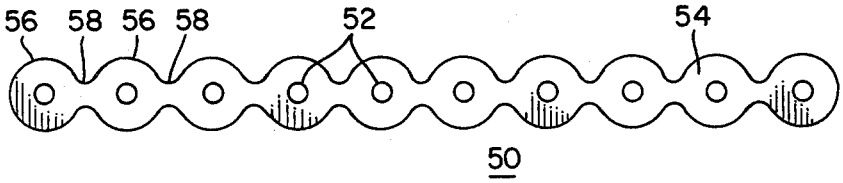
FIG. 3 is an end elevational view of a typical round conductor flat cable.
Figure 4:
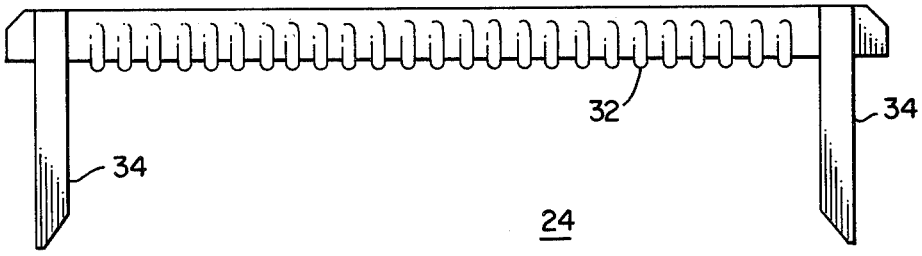
FIG. 4 is a front elevational view of the cover of the connector of FIG. 1.
Figure 5:
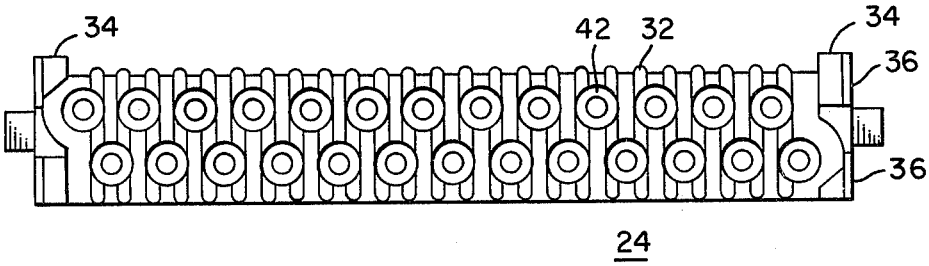
FIG. 5 is a bottom plan view of the cover of FIG. 4.
Figure 8:
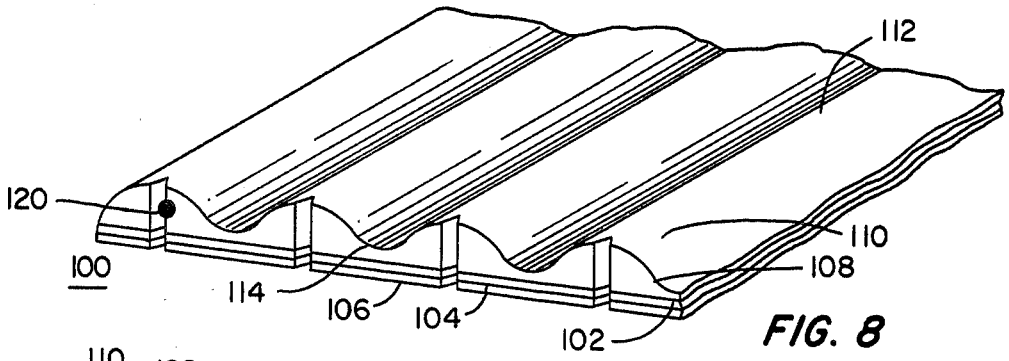
FIG. 8 is a fragmentary, front perspective of an adaptor constructed in accordance with the concepts of the invention.
Figure 9:
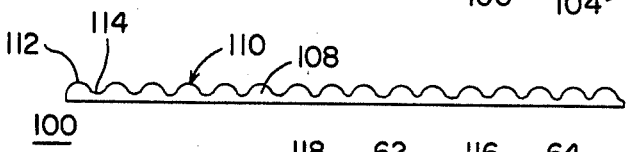
FIG. 9 is a front elevational view of the adaptor of FIG. 8.
Figure 10:
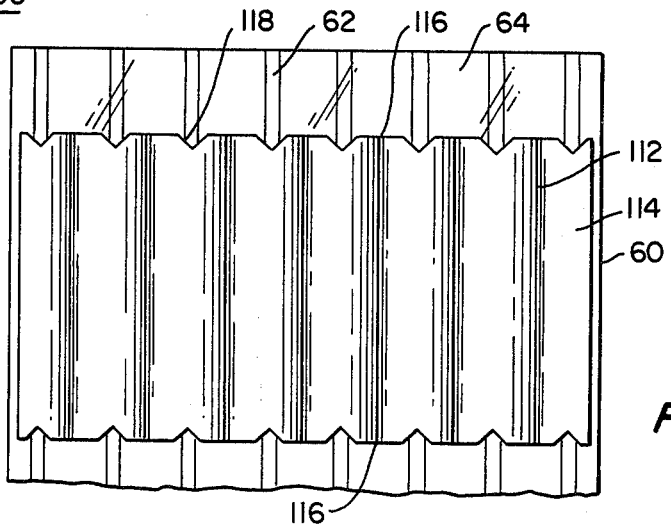
FIG. 10 is a top plan view of the adaptor of FIG. 8 placed upon a flat conductor flat cable.
Figure 11:
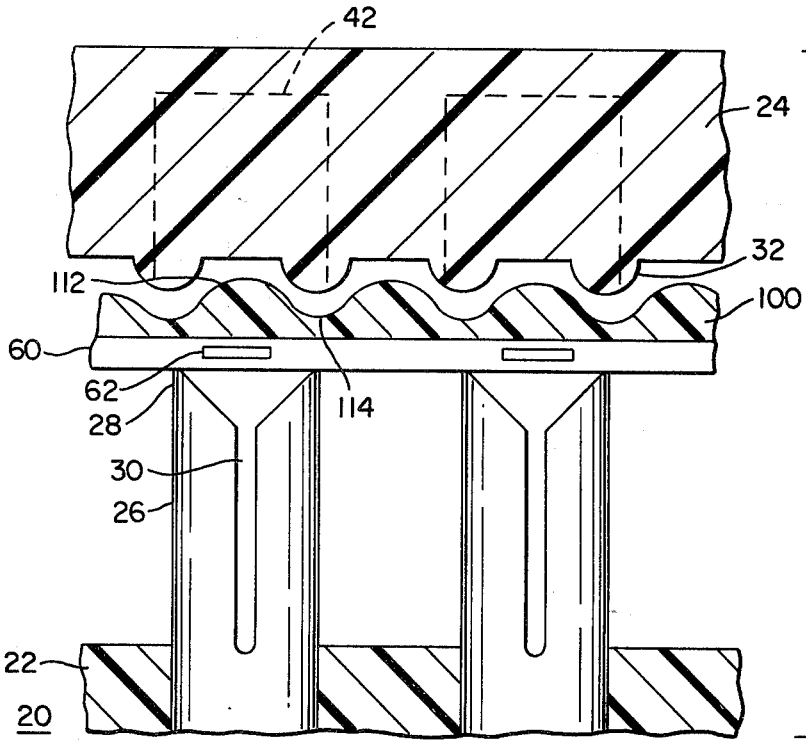
FIG. 11 is an exploded fragmentary, partly in section, side elevational view of the connector of FIG. 6 in the pre-latched condition with the adaptor of the invention installed to the flat conductor flat cable within the connector.

Turning now to FIGS. 1 to 5, a typical connector 20 for use with round conductor flat cable is shown along with the details of flat conductor flat cable and round conductor flat cable. Round conductor flat cable 50 (see FIG. 3) is formed of individual round conductors 52 over which a jacket 54 of insulating material is placed by molding, lamination or extrusion. The jacket 54 follows the contours of the round conductors 52 and thus there are hills 56 over the conductors 52 and valleys 58 between adjacent conductors 52. In distinction, flat conductor flat cable 60 (see FIG. 2) has flat conductors 62 (square or rectangular, the latter being shown) in a jacket 64 which is flat and without any detail on either side 66, 68.

The connector 20 has a body 22 with a cover 24 arranged to lockingly engage the body 22. The cover 24 has a series of legs 34 which extend down to inturned ribs 36. When the ribs 36 engage stop 38 on the body 22 then the body and cover are assembled in the prelatch condition where cover 24 is sufficiently spaced from the body 22 to permit either flat cables 50 or 60 to pass between the covers and the tops of the contacts in the body 22. A second stop 40 is found on the body 22 and when the inturned ribs 36 are positioned about stop 40 the connector 20 is in its fully engaged or latched condition. The round conductor flat cable 50 will be in intimate contact with the body 22 and the cover 24 and the contacts, as will be set forth below, will have pierced the insulation and proceeded into the recesses in the cover 24.

Extending through body 22 are a plurality of bores (not shown) into which are placed electrical contacts of the insulation piercing type having insulation piercing points 28 and insulation displacing slots 30. This type of contact is fully disclosed in U.S. Pat. No. 3,964,816 issued June 29, 1976. The contact 26 ends extend into a series of recesses 42 in the interior surface of the cover 24. One such recess 42 is provided for each contact 26 and normally in line with its associated contact 26. In addition to the recesses 42 the cover 24 also has a series of guides 32 which mate with the valleys 58 of the round conductor flat cable 50 to guide the cable 50 into the connector 20.

The connector 20 is originally in its pre-latched condition with the cover 24 separate from the body 22 by a sufficient distance to allow a round conductor flat cable 50 to pass between the interior surface of the cover 24 and the upper pointed edges 28 of the contacts 26. The cover 24 is held in this position by the inturned ribs 36 of legs 34 and stop 38 of body 22. The flat cable 50 is guided so that the individual conductors 52 are each engaged by one contact 26 by means of the guides 32 on the cover 24 and their engagement with the valleys 58 of the cable 50. Once the cable 50 is in place, the cover 24 is moved to its latched position wherein the inturned ribs 36 of the legs 34 engage stop 40. The points 28 of the contacts 26 tear the insulation between conductors 52 and force one conductor towards slot 30 which cuts the insulation 54 to the conductor 52 and makes good mechanical and electrical contact therewith.

Referring now to FIGS. 6 and 7, the functioning and drawbacks of U.S. Pat. No. 3,994,554 issued Nov. 30, 1976 can be set forth. Because of manufacturing tolerances in the connector 20 it is necessary that the prior art adaptor 80 have apertures 82 large enough to fit all size combinations of the contact 26 and, as a result, there is a great deal of slop as is clearly visible at 84 in FIG. 6. The adaptor 80 has been adhered to the flat conductor flat cable 60 and each of the apertures 82 has been positioned over a contact 26 so that the individual flat conductors 62 are properly positioned with respect to the slot 30 in the contact 26. The connector 20 is in the pre-latched position.

The connector 20 is now closed or moved to the latched position, as is shown in FIG. 7. Since the round conductor flat cable 50 is higher than the flat conductor flat cable 60, there is immediately a gap 86 between the flat conductor flat cable 60 and the interior surface of the cover 24. This gap 86 permits the cable 60 to move in the connector and could result in damage to the contacts 26 or the conductors 62. The slop 84 permits a lateral shift of the cable 60 and adaptor 80 along the connector 20 body 22. The absence of any force pushing downwardly upon the flat conductors 62 permits same to be displaced or distorted rather than forced into a good contact with the contacts 26.

Turning now to FIGS. 8 to 13, an adaptor 100 constructed in accordance with the concepts of the invention is shown. Adaptor 100 has a flat, planar bottom surface 102 to which is applied a pressure-sensitive adhesive layer 104 which can be applied with a suitable release layer 106. The top surface 108 is made to undulate as at 110 and the crests 112 (see FIG. 9) are the same as the separation between the flat conductors 62 of the flat cable 60. The troughs 114 correspond to the ridges 32 of the cover 24 to permit the adaptor 100 to be accurately positioned with respect to cover 24 and thus body 22.

Figure 13:
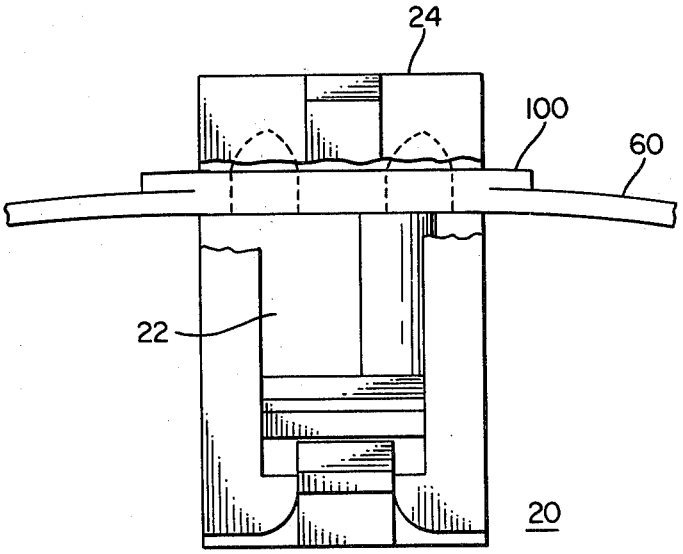
FIG. 13 is a side elevational view of the connector of FIG. 1 installed to a length of flat conductor flat cable and illustrating a modification of the adaptor of this invention.

The adaptor 100 may be made, for example, from vinyl by an extrusion or lamination process. The adaptor 100 may be made in long continuous lengths and cut to desired size. A first size would be equal to the width of the connector 20 whereas other sizes would be made much wider than the connector 20 to provide strain relief to the cable 60, as is shown in FIG. 13. At the time the individual adaptors 100 are severed, the marginal edges (see FIG. 10) 116 are notched as at 118 in the crested portion of the undulating surface 110 of the adaptor. To align the adaptor 100 with the individual conductors 62 of the flat conductor flat cable 60 it is only necessary to align the apex of the notches 118 with the centers of the flat conductors 62. The adaptor 100 is pressed onto the cable 60 to adhere it thereto using the adhesive layer 104 after the release layer 106 is removed. If desired, a rod-like stiffener 120 can be added to provide additional support for the conductor 62 in the slot 30 of contact 26. The stiffener 120 extends the length of adaptor 100.

Figure 12:
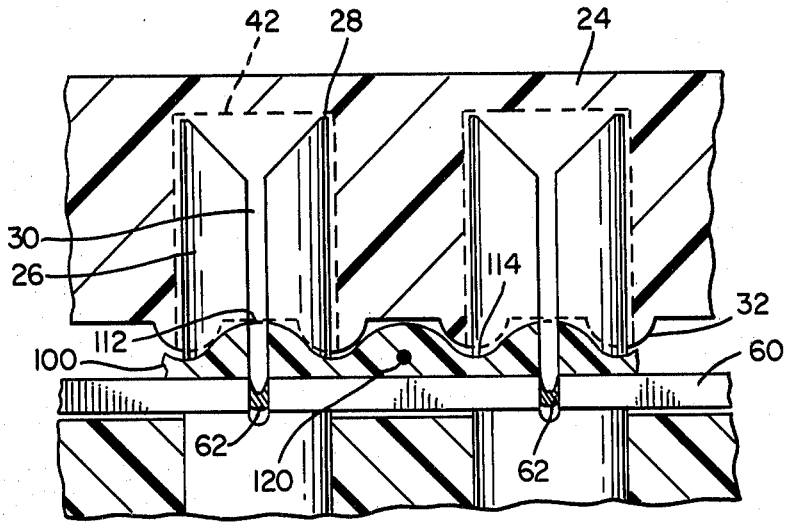
FIG. 12 shows the connector of FIG. 11 in the fully latched condition.

After the adaptor 100 has been adhered to cable 60 the cable 60 and adaptor 100 can now be positioned in the connector 20 with the troughs 114 aligned with the ridges 32. This positions the conductors 62 over the contacts 26 (see FIG. 11). The connector 20 is now closed, as is shown in FIG. 12. Because of the thickness and undulating upper surface 110 of the adaptor 100, the gap found in the prior art device does not exist. Also, the close-fitting adaptor, that is because the contacts 26 cut through the adaptor 100 and the material of the adaptor 100 recovers to fit closely about the intruded contact 26, leaves no room for lateral shift of the adaptor 100 along with the cable 60. Finally, the material of the adaptor 100 above the conductor 62 tends to force it to the base of slot 30 to assume the best contact. The stiffener 120 acts to resist upward movement of the conductor 62 through the adaptor 100 and serves to retain the conductor 92 at the desired base of the slot 30.

While there have been shown and described and pointed out the fundamental novel features of the invention as applied to the preferred embodiment, it will be understood that various omissions and substitutions and changes of the form and details of the devices illustrated and in its operation may be made by those skilled in the art, without departing from the spirit of the invention.

The embodiments of the invention in which an exclusive property or privilege is claimed are defined as follows:

1. An adaptor for attachment to a substantially planar surface of a flat cable having a plurality of spaced conductors therein, said adaptor comprising: a layer of non-conductive material having a first substantially flat planar surface and a second undulating surface opposite said first surface and defining a plurality of periodically disposed crests and troughs, said layer of non-conductive material having two opposed marginal edges, said crests and troughs extending transversely thereto, a plurality of notches in at least one of said marginal edges and spaced therealong at intervals substantially the same as the periodic distance between crests; a layer of adhesive on said first planar surface for adherence to said surface of said flat cable; and at least one stiffener element contained within said layer of non-conductive material to provide stiffness thereto.

2. An adaptor according to claim 1, wherein, said stiffener element is generally rodlike.

3. An adaptor according to claim 2, wherein said rodlike stiffener is aligned in said non-conductive material with one of said crests.

4. An adaptor according to claim 1, wherein said notches are aligned in registry with said crests.

5. An adaptor according to claim 1, wherein said layer of non-conductive material comprises permeable material with an elastic memory.

6. An adaptor according to claim 1, further including a release layer affixed over said adhesive layer on said first planar surface.

7. In combination, a flat cable having a top substantially planar surface, a bottom substantially planar surface and a plurality of substantially parallel conductors extending therein, said conductors being spaced apart at predetermined intervals; and an alignment adaptor attached to said flat cable, said adaptor including a layer of non-conductive material having a first substantially planar surface with a layer of adhesive adhered thereto and to one of said top or bottom surfaces of said flat cable, and a second undulating surface defining a plurality of periodically disposed crests and troughs, the periodic interval being such that said crests and troughs of said undulating surface are aligned with the conductors of said flat cable.

8. The combination according to claim 7, wherein the periodic interval of said crests and troughs is such that a crest lies in registry with each conductor of said flat cable.

9. The combination according to claim 7, wherein said layer of non-conductive material includes at least one stiffener element disposed therein.

10. The combination according to claim 9, wherein a plurality of stiffener elements are disposed in said non-conductive layer, a stiffener element being in registry with each of said crests.

11. The combination according to claim 7, wherein said non-conductive layer of said adaptor defines two marginal edges, said crests and troughs extending transversely thereto, a plurality of notches in at least one of said edges and spaced therealong to lie in substantial registry with the crests of said undulating surface.

12. A kit of parts comprising:

(a) a flat cable having a top substantially planar surface and a bottom substantially planar surface and a plurality of substantially parallel conductors extending therein, said conductors being spaced apart at predetermined intervals; and (b) an adaptor adapted to be attached to one of said bottom or top surfaces, said adaptor including a layer of non-conductive material having a first substantially planar surface and a second undulating surface defining a plurality of periodically disposed crests and troughs, and a layer of adhesive on said first surface adapted to be adhered to said one of said bottom or top surfaces such that said crests and troughs are aligned with the conductors of said flat cable.

13. A kit according to claim 12, wherein said crests are spaced to be in registry with said conductors of said flat cable upon adherence of said layer of adhesive with said bottom or top surface.

14. A kit according to claim 12, wherein said layer of non-conductive material includes at least one stiffener element adapted to provide stiffness to said adaptor.

15. A kit according to claim 14, wherein a plurality of stiffener elements are provided in registry with said crests.

* * * * *